US008172521B2

(12) United States Patent
Tillery et al.

(10) Patent No.: US 8,172,521 B2
(45) Date of Patent: May 8, 2012

(54) COMPRESSOR CLEARANCE CONTROL SYSTEM USING TURBINE EXHAUST

(75) Inventors: Steven W. Tillery, Simpsonville, SC (US); Mark W. Flanagan, Simpsonville, SC (US); David A. Snider, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 760 days.

(21) Appl. No.: 12/354,049

(22) Filed: Jan. 15, 2009

(65) Prior Publication Data

US 2010/0178152 A1 Jul. 15, 2010

(51) Int. Cl.
*F03B 11/00* (2006.01)

(52) U.S. Cl. ..... 415/180; 415/1; 415/134; 415/173.1

(58) Field of Classification Search ..... 415/1, 134, 415/173.1, 177, 180
See application file for complete search history.

(56) References Cited

U.S. PATENT DOCUMENTS

| | | | | |
|---|---|---|---|---|
| 4,507,914 | A * | 4/1985 | Rice | 60/39.17 |
| 5,167,487 | A * | 12/1992 | Rock | 415/173.3 |
| 6,027,304 | A | 2/2000 | Arar et al. | |
| 7,255,531 | B2 * | 8/2007 | Ingistov | 415/173.1 |
| 7,293,953 | B2 * | 11/2007 | Leach et al. | 415/14 |
| 2006/0042266 | A1 | 3/2006 | Albers et al. | |
| 2007/0039305 | A1 | 2/2007 | Taha et al. | |
| 2007/0240400 | A1 | 10/2007 | Smith et al. | |
| 2008/0267769 | A1 | 10/2008 | Schwarz et al. | |

* cited by examiner

*Primary Examiner* — Stephen W Smoot
*Assistant Examiner* — Vicki B Booker
(74) *Attorney, Agent, or Firm* — Sutherland Asbill & Brennan LLP

(57) ABSTRACT

The present application provides a compressor clearance control system for a gas turbine engine. The gas turbine engine includes a turbine producing exhaust gases and a compressor with a casing and a number of rotor blades. The compressor clearance control system may include a casing heat exchanger positioned about the casing of the compressor and an extraction port for exhaust gases from the turbine. The extraction port is in communication with the casing heat exchanger so as to heat the casing of the compressor with the exhaust gases from the turbine.

17 Claims, 2 Drawing Sheets

COMPRESSOR CLEARANCE CONTROL SYSTEM USING TURBINE EXHAUST

TECHNICAL FIELD

The present application relates generally to gas turbine engines and more particularly relates to a compressor clearance control system for providing front end rotor blade clearance or other types of clearance control through the use of turbine exhaust gases.

BACKGROUND OF THE INVENTION

When overall power demand is low, power producers often turn their power generation equipment to a low power level so as to conserve fuel. In the case of a gas turbine engine, the inlet guide vanes about a compressor inlet may be closed to a minimum angle so as to reduce the airflow therethrough and the overall power output. Specifically, the air passing through the inlet guide vanes may experience a significant pressure drop at the low inlet guide vane angles. The front end of the compressor essentially acts as a turbine and extracts energy from the airflow in a phenomenon called turbining. The low pressure thus may cause the temperature of the airflow about the compressor inlet casing to drop quickly. Such low temperatures may require more steady state clearances between the casing and the rotor blades to allow for stabilization.

Because the metal casing of the compressor has a slower thermal response time than the rotor blades, the rotor blades may expand faster than the casing so as to cause the rotor blades to close in on the casing and potentially rub thereagainst when in transition to higher loads or in an overspeed condition. Rubbing may cause early rotor blade damage and possible failure. As a result, operational rotor blade/casing clearances must accommodate these differing expansion rates. These clearances effect and thereby limit the amount of core flow that may be pulled into the compressor.

There is therefore a desire for improved clearance control systems and methods for a compressor so as to improve overall gas turbine engine performance and efficiency. Preferably, the improved compressor clearance control systems and methods also should address turbining during low or no load conditions as well rotor blade rubbing during load transitions. Specifically, reducing the range of clearances over the operating regime without the danger of not enough clearances (rubbing, damage) or the danger of too much clearance (loss of performance, stall, damage).

SUMMARY OF THE INVENTION

The present application thus provides a compressor clearance control system for a gas turbine engine. The gas turbine engine includes a turbine producing exhaust gases and a compressor with a casing and a number of rotor blades. The compressor clearance control system may include a casing heat exchanger positioned about the casing of the compressor and an extraction port for exhaust gases from the turbine. The extraction port is in communication with the casing heat exchanger so as to heat the casing of the compressor with the exhaust gases from the turbine.

The present application further describes a method of providing clearance control for a gas turbine engine having a turbine producing exhaust gases and a compressor with a casing and a number of rotor blades. The method includes the steps of rotating the rotor blades within the casing, extracting heat from the turbine, communicating that heat to the casing, and thermally expanding the casing or preventing the casing from thermally contracting.

The present application further provides a compressor clearance control system for a gas turbine engine. The gas turbine engine includes a turbine producing exhaust gases and a compressor with a casing and a number of rotor blades. The compressor clearance control system may include a casing heat exchanger positioned about the casing of the compressor, an extraction port for exhaust gases from the turbine, and one or more conduits extending from the extraction port to the casing heat exchanger so as to heat the casing of the compressor with the exhaust gases from the turbine.

These and other features and improvements of the present application will become apparent to one of ordinary skill in the art upon review of the following detailed description when taken in conjunction with the several drawings and the appended claims.

DETAILED DESCRIPTION

Figure 1:
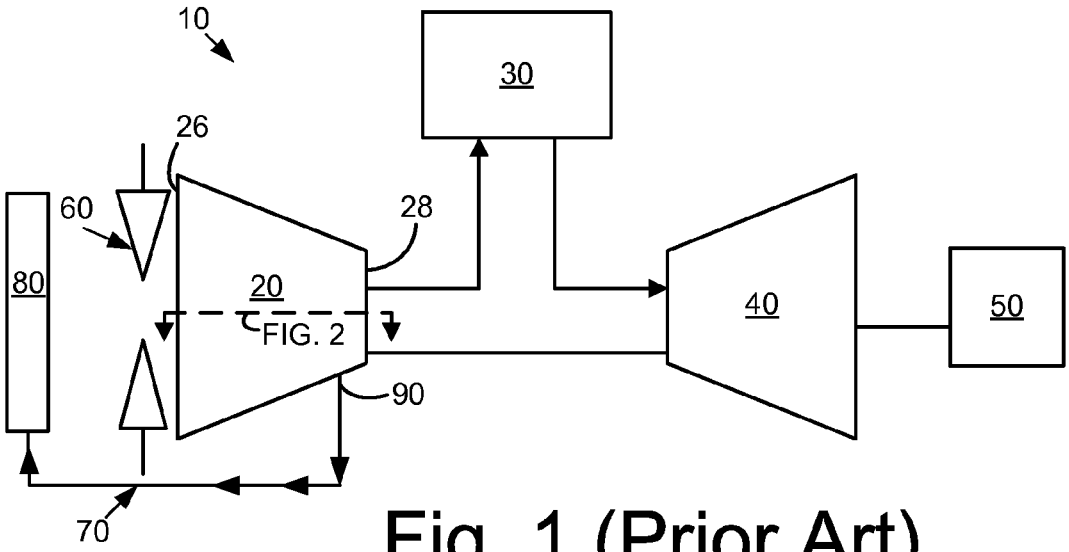
Fig. 1 (Prior Art)
FIG. 1 is a schematic view of a known gas turbine engine.
Figure 2:
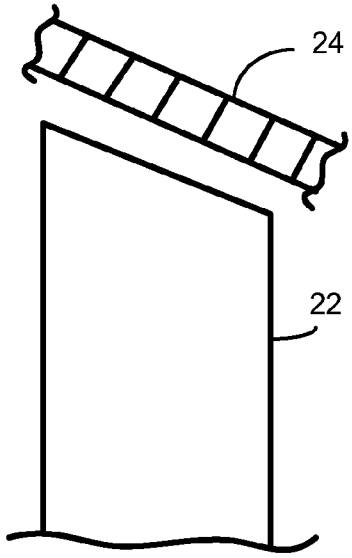
Fig. 2 (Prior Art)
FIG. 2 is a cross-sectional view of a rotor blade positioned about a compressor casing.

Referring now to the drawings in which like numerals refer to like elements throughout the several views, FIGS. 1 and 2 show a schematic view of a gas turbine engine 10. As is known, the gas turbine engine 10 may include a compressor 20 to compress an incoming flow of air. The compressor 20 includes a number of rotor blades 22 positioned within a casing 24. The compressor 20 delivers the compressed flow of air to a combustor 30. The combustor 30 mixes the compressed flow of air with a flow of fuel and ignites the mixture. (Although only a single combustor 30 is shown, the gas turbine engine 10 may include any number of combustors 30.) The hot combustion gases are in turn delivered in turn to a turbine 40. The hot combustion gases drive the turbine 40 so as to produce mechanical work. The mechanical work produced in the turbine 40 drives the compressor 20 and an external load 50 such as an electrical generator and the like. The gas turbine engine 10 may use natural gas, various types of syngas, and other types of fuels.

The gas turbine engine 10 may be a 9FA turbine or a similar device offered by General Electric Company of Schenectady, N.Y. Other types of gas turbine engines 10 may be used herein. The gas turbine engine 10 may have other configurations and use other types of components. Multiple gas turbine engines 10, other types of turbines, and/or other types of power generation equipment may be used together.

Load control for the gas turbine engine 10 may be possible in part through the use of a number of inlet guide vanes 60 positioned about an inlet 26 of the compressor 20. Specifically, the output of the gas turbine engine 10 may be modulated by changing the position of the inlet guide vanes 60 so as to vary the amount of air entering the compressor 20.

The gas turbine engine 10 also may use an inlet bleed heat system 70 to heat the inlet air. The inlet bled heat system 70 may be positioned upstream of the inlet of the compressor 20 in a filter housing or elsewhere. As is known, the inlet bleed heat system 70 may include an inlet bled heat manifold 80 positioned upstream of the inlet 26 of the compressor 20. The inlet bled heat manifold 80 may be in communication with an extraction port 90 of compressed air from a compressor outlet 28. The air from the extraction port 90 passes through the inlet bled heat manifold 80 so as to warm the incoming air flow. Warming the incoming air flow aids in limiting the implications of turbining (i.e., casing shrinkage resulting in blade rubbing). Other methods and configurations may be used herein.

The efficiency of the compressor cycle, however, may be compromised by extracting the compressed air from the outlet 28 of the compressor 20 and using it to heat the inlet air flow. As such, overall gas turbine engine efficiency likewise may be reduced. Likewise, other types of turbines may not use an inlet bled heat system 70 while suppressed inlet temperatures may remain an issue.

Figure 3:
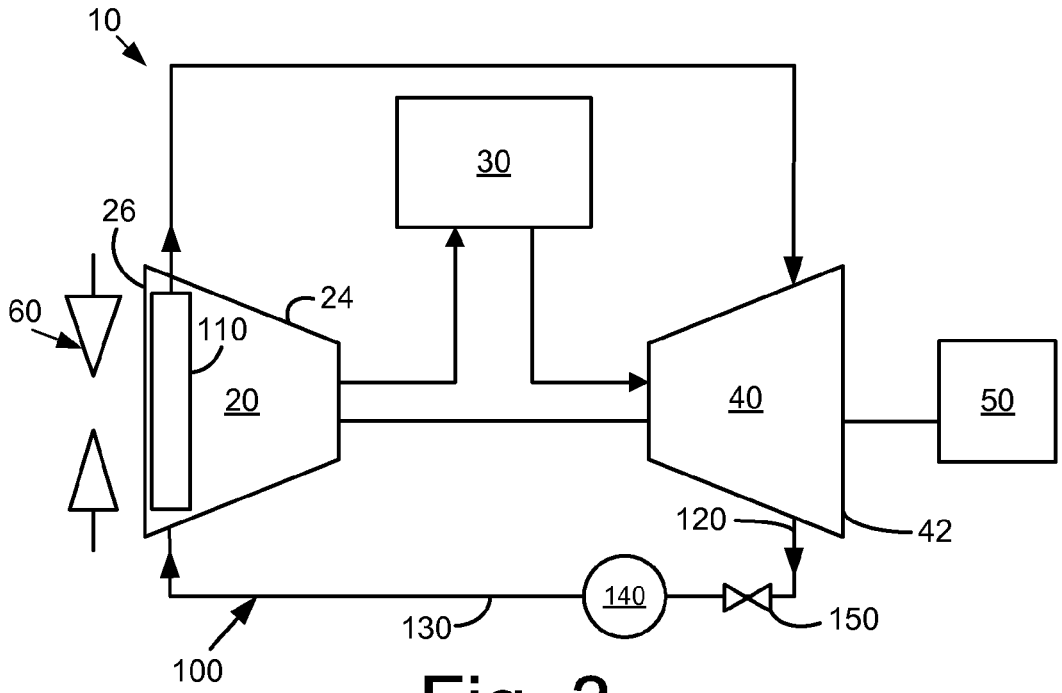
FIG. 3 is a schematic view of a gas turbine engine with a compressor clearance control system as is described herein.

FIG. 3 shows a compressor clearance control system 100 as is described herein. The compressor clearance control system 100 may be installed within the gas turbine engine 10 as described above. The compressor clearance control system 100 likewise may be used with other types of turbine systems.

The compressor clearance control system 100 may include a compressor casing heat exchanger 110. The casing heat exchanger 110 may be any type of heat exchanger that transfers heat to the casing 24 of the compressor 20 about the inlet 26 or otherwise. The compressor casing heat exchanger 110 may be used in any stage or in any position. The compressor clearance control system 100 further includes an extraction port 120 about an outlet 42 of the turbine 40 downstream of all of the turbine stages. Specifically, hot exhaust gases from the outlet 42 of the turbine 40 may be removed via the extraction port 120. The hot exhaust gases from the extraction port 120 may be in communication with the casing heat exchanger 110 via one or more conduits 130. After passing through the casing heat exchanger 110, the gases then may be vented or piped back to the exhaust at the turbine outlet 42 with little impact on the overall bulk exhaust temperature. A pump 140 may be positioned about the conduit 130 if needed. Likewise, one or more valves 150 may be positioned on the conduit 130 as may be required.

The heat from the hot exhaust gases of the turbine 40 is thus transferred to the metal of the casing 24 about the inlet 26 of the compressor 20. As such, shrinkage or thermal contraction of the casing 24 of the compressor 20 may be controlled so as to avoid rubbing by the rotor blades 22. Likewise, expansion of the casing 24 may be promoted. The compressor clearance control system 100 thus may be used when the inlet guide vanes 60 are close to or about at a minimum angle due to, for example, low load or no load conditions. Likewise, the compressor clearance control system 100 may be used in cold ambient conditions and during load transitions. The gas turbine engine 10 thus may be turned down to a lower power with less of a chance for rotor blade rubbing due to turbining. Likewise, the inlet guide vanes 60 may be closed to a lower angle so as to turn down even further the power output.

The compressor clearance control system 100 not only permits lower turndown, but also may promote higher overall power output. Overall operational rotor blade tip clearances may be tightened given the increased controllability over the casing temperature via longer rotor blades 22. Specifically, tightening the rotor blade clearances should result in a power output increase. The improvement will vary greatly for different types of turbines. Moreover, the compressor clearance control system 100 uses waste heat from the turbine 40 so as to limit the efficiency penalty associated with known inlet bleed heat systems and other known techniques.

The compressor clearance control system 100 may be installed in new or existing gas turbine engines 10. The compressor clearance control system 100 may be used on any machine where turbining or active clearance control may be an issue.

Figure 4:
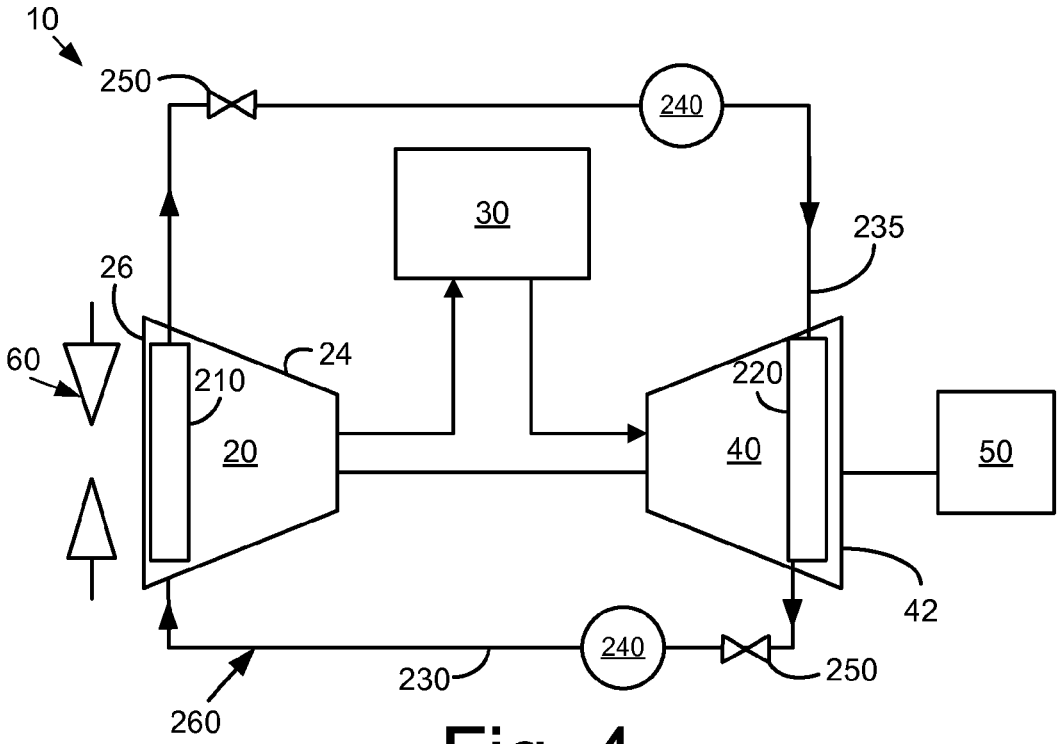
FIG. 4 is a schematic view of a gas turbine engine with an alternative embodiment of the compressor clearance control system as is described herein.

FIG. 4 shows a further embodiment of a compressor clearance control system 200. This embodiment also includes a casing heat exchanger 210 positioned on the casing 24 of the compressor 20 about the inlet 26. The compressor clearance control system 200 also includes a turbine exhaust heat exchanger 220. The turbine exhaust heat exchanger 220 may be positioned about the outlet of the turbine 40 or other type of downstream exhaust system for heat exchange therewith. The casing heat exchanger 210 of the compressor 20 and the turbine exhaust heat exchanger 220 of the turbine 40 may be in communication via one or more conduits 230. The conduit 230 may have a conventional refrigeration fluid or other type of working fluid 235 therein for circulation from the turbine exhaust heat exchange 220 to the casing heat exchanger 210 and back. One or more pumps 240 may be positioned about the conduit 230. Likewise, one or more valves 250 may be positioned thereon.

The working fluid 235 may be heated in the turbine exhaust heat exchanger 220 via the turbine exhaust and then circulated through the casing heat exchanger 210 about the casing 24 of the compressor 200 so as to exchange heat with the metal of the casing 24. The working fluid 235 then may be circulated back to the turbine exhaust heat exchanger 220. Other types of heat circulation systems likewise may be used herein.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

We claim:

1. A compressor clearance control system for a gas turbine engine having a turbine producing exhaust gases and a compressor with a casing and a number of rotor blades, comprising:

a casing heat exchanger positioned about the casing of the compressor;

an extraction port for exhaust gases from the turbine; and a turbine exhaust heat exchanger in communication with the extraction port;

wherein the turbine exhaust heat exchanger is in communication with the casing heat exchanger so as to heat the casing of the compressor with the exhaust gases from the turbine.

2. The compressor clearance control system of claim 1, wherein the casing heat exchanger and the extraction port are in communication via one or more conduits.

3. The compressor clearance control system of claim 2, further comprising a pump positioned on the one or more conduits.

4. The compressor clearance control system of claim 2, further comprising a valve positioned on the one or more conduits.

5. The compressor clearance control system of claim 2, wherein the exhaust gases are in communication with the extraction port and the casing heat exchanger via the one or more conduits and in communication with the casing heat exchanger and an outlet of the turbine via the one or more conduits.

6. A method of providing clearance control for a gas turbine engine having a turbine producing exhaust gases and a compressor with a casing and a number of rotor blades, comprising:

rotating the number of rotor blades within the casing;

extracting heat from the turbine via a turbine exhaust heat exchanger;

communicating that heat to the casing via a casing heat exchanger in communication with the turbine exhaust heat exchanger and positioned about the casing of the compressor; and thermally expanding the casing or preventing the casing from thermally contracting.

7. The method of claim 6, wherein the step of extracting heat from the turbine comprises extracting exhaust gases from the turbine.

8. The method of claim 7, wherein the step of communicating that heat to the casing comprises flowing the exhaust gases through a casing heat exchanger positioned about the casing.

9. The method of claim 7, further comprising the step of returning the exhaust gases to the turbine.

10. The method of claim 6, further comprising reducing a clearance between the casing and the number of rotor blades by increasing the size of the number of rotor blades.

11. The method of claim 6, wherein the step of extracting heat from the turbine comprises positioning a turbine exhaust heat exchanger about an outlet of the turbine.

12. The method of claim 11, wherein the step of communicating that heat to the casing comprises positioning a casing heat exchanger about the casing and circulating a working fluid between the turbine exhaust heat exchanger and the casing heat exchanger.

13. A compressor clearance control system for a gas turbine engine having a turbine producing exhaust gases and a compressor with a casing and a number of rotor blades, comprising:

a casing heat exchanger positioned about the casing of the compressor;

an extraction port for exhaust gases from the turbine; and a turbine exhaust heat exchanger in communication with the extraction port;

one or more conduits extending from the extraction port to the turbine exhaust heat exchanger and the casing heat exchanger so as to heat the casing of the compressor with the exhaust gases from the turbine.

14. The compressor clearance control system of claim 13, further comprising a pump positioned on the one or more conduits.

15. The compressor clearance control system of claim 13, further comprising a valve positioned on the one or more conduits.

16. The compressor clearance control system of claim 13, wherein the exhaust gases are in communication with extraction port and the casing heat exchanger via the one or more conduit and in communication with the casing heat exchanger and an outlet of the turbine via the one or more conduits.

17. The compressor clearance control system of claim 13, further comprising a plurality of inlet guide vanes positioned about compressor.

* * * * *